US007794552B2

(12) United States Patent
Cugy et al.

(10) Patent No.: US 7,794,552 B2
(45) Date of Patent: Sep. 14, 2010

(54) METHOD OF PRODUCING AUSTENITIC IRON/CARBON/MANGANESE STEEL SHEETS HAVING VERY HIGH STRENGTH AND ELONGATION CHARACTERISTICS AND EXCELLENT HOMOGENEITY

(75) Inventors: Philippe Cugy, Thionville (FR); Nicolas Guelton, Metz (FR); Colin Scott, Montigny les Metz (FR); Francois Stouvenot, Labry (FR); Marie-Christine Theyssier, Metz (FR)

(73) Assignee: Arcelor France, Saint Denis (FR)

( * ) Notice: Subject to any disclaimer, the term of this patent is extended or adjusted under 35 U.S.C. 154(b) by 526 days.

(21) Appl. No.: 11/720,018

(22) PCT Filed: Nov. 4, 2005

(86) PCT No.: PCT/FR2005/002740

§ 371 (c)(1),
(2), (4) Date: Oct. 4, 2007

(87) PCT Pub. No.: WO2006/056670

PCT Pub. Date: Jun. 1, 2006

(65) Prior Publication Data

US 2008/0035248 A1 Feb. 14, 2008

(30) Foreign Application Priority Data

Nov. 24, 2004 (FR) ..... 04 12477

(51) Int. Cl.
*C22C 38/04* (2006.01)
*C21D 8/02* (2006.01)

(52) U.S. Cl. ..... 148/337; 148/620; 148/602; 148/603; 420/72

(58) Field of Classification Search ..... 148/541, 148/547, 620, 337, 602, 603; 420/72–76, 420/99

See application file for complete search history.

(56) References Cited

U.S. PATENT DOCUMENTS 2,378,994 A * 6/1945 Russell Franks ..... 148/329

(Continued)

FOREIGN PATENT DOCUMENTS

EP 1 067 203 1/2001

(Continued)

OTHER PUBLICATIONS

Derwent publication Acc-No. 2003-301246, English abstract of WO 03025240, Mar. 27, 2003, Guelton et al.*

(Continued)

*Primary Examiner*—Deborah Yee
(74) *Attorney, Agent, or Firm*—Oblon, Spivak, McClelland, Maier & Neustadt, L.L.P.

(57) ABSTRACT

A hot-rolled austenitic iron/carbon/manganese steel sheet, the strength of which is greater than 1200 MPa, the product P (strength (in MPa)×elongation at break (in %)) of which is greater than 65 000 MPa % and the nominal chemical composition of which comprises, the contents being expressed by weight: 0.85%≦C≦1.05%; 16%≦Mn≦19%; Si≦2%; Al≦0.050%; S≦0.030%; P≦0.050%; N≦0.1%, and, optionally, one or more elements chosen from: Cr≦1%; Mo≦0.40%; Ni≦1%; Cu≦5%; Ti≦0.50%; Nb≦0.50%; V≦0.50%, the rest of the composition consisting of iron and inevitable impurities resulting from the smelting, the recrystallized surface fraction of said steel being equal to 100%, the surface fraction of precipitated carbides of said steel being equal to 0% and the mean grain size of said steel being less than or equal to 10 microns.

19 Claims, 1 Drawing Sheet

U.S. PATENT DOCUMENTS

Figure 1:
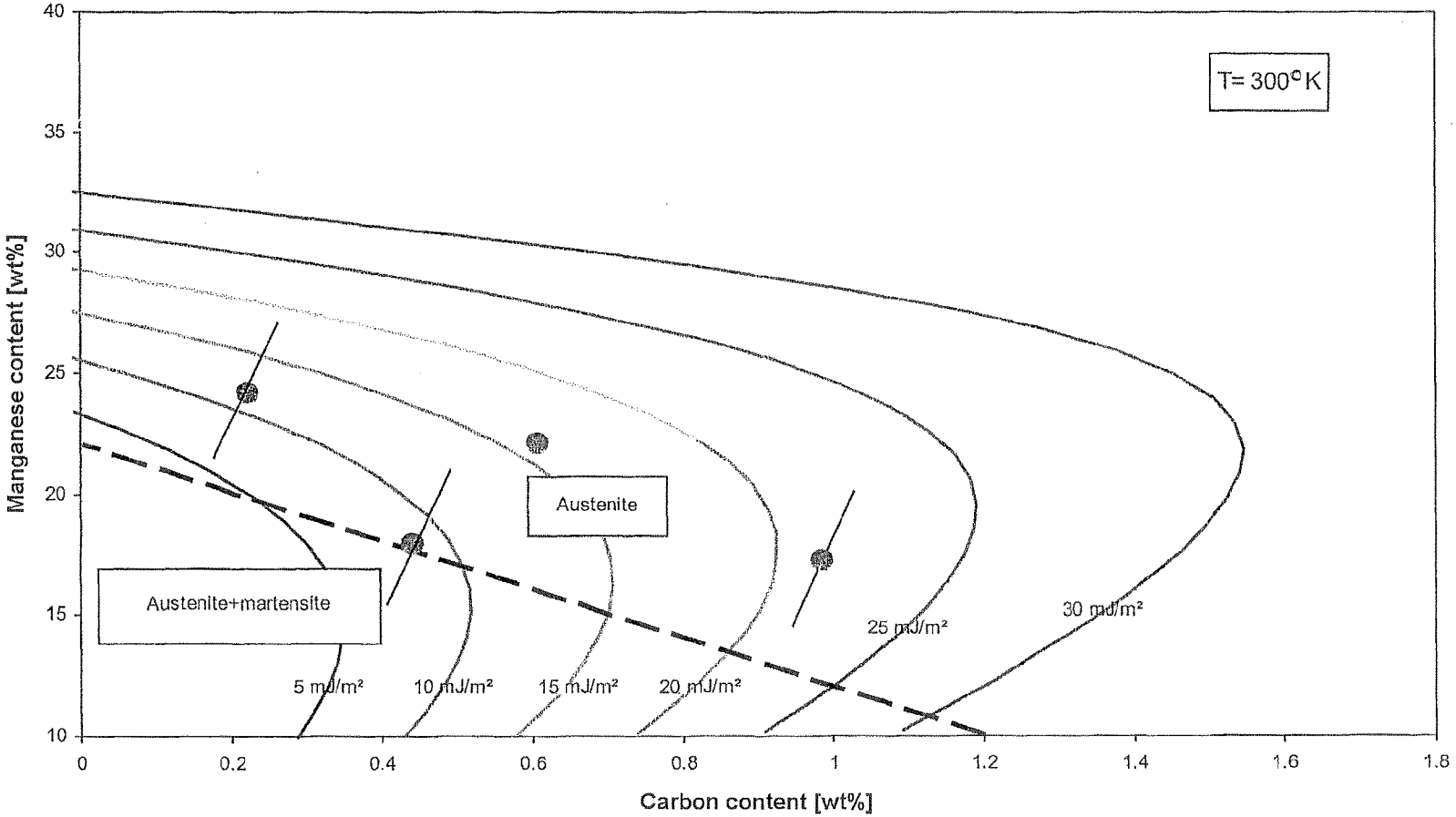

| | | | | |
|---|---|---|---|---|
| 4,484,958 | A * | 11/1984 | Shintani et al. | 420/44 |
| 5,431,753 | A | 7/1995 | Kim et al. | |
| 2009/0074605 | A1 * | 3/2009 | Kim et al. | 420/75 |
| 2009/0202382 | A1 * | 8/2009 | Kim et al. | 420/74 |

FOREIGN PATENT DOCUMENTS

| | | | |
|---|---|---|---|
| FR | 2 068 283 | | 8/1971 |
| FR | 2 829 775 | | 3/2003 |
| JP | 03013525 | | 1/1991 |
| JP | 4 143218 | | 5/1992 |
| JP | 4 247851 | | 9/1992 |
| JP | 04-259325 | * | 9/1992 |

OTHER PUBLICATIONS

U.S. Appl. No. 12/373,152, filed Jan. 9, 2009, Scott, et al.
U.S. Appl. No. 11/814,329, filed Jul. 19, 2007, Scott, et al.

* cited by examiner

METHOD OF PRODUCING AUSTENITIC IRON/CARBON/MANGANESE STEEL SHEETS HAVING VERY HIGH STRENGTH AND ELONGATION CHARACTERISTICS AND EXCELLENT HOMOGENEITY

The present invention relates to the manufacture of hot-rolled and cold-rolled austenitic iron/carbon/manganese steel sheet exhibiting very high mechanical properties and, in particular, a highly advantageous combination of mechanical strength and elongation at break, together with excellent homogeneity of the mechanical properties.

In the automotive field, the continual increase in the level of equipment in vehicles makes it even more necessary to lighten the metal structure itself. To do this, each function has to be rethought in order to improve its performance and reduce its weight. Various families of steels have thus been developed for the purpose of meeting these ever-increasing requirements: in chronological order, mention may for example be made of high-yield-strength steels hardened by a fine precipitation of niobium, vanadium or titanium; steels with dual-phase structures (ferrite containing up to 25% martensite); and TRIP (transformation induced plasticity) steels composed of ferrite, martensite and austenite capable of being transformed under deformation. For each type of structure, the tensile strength and deformability are competing properties, so much so that it is generally not possible to obtain very high values for one of the properties without drastically reducing the other. Thus, in the case of TRIP steels, it is difficult to obtain a strength greater than 900 MPa simultaneously with an elongation greater than 25%. Steels having a bainitic or martensitic-bainitic structure may also be mentioned, the strength of which may be up to 1200 MPa on hot-rolled sheet, but the elongation of which is only around 10%. Although these properties may be satisfactory for a number of applications, they nevertheless remain insufficient if further lightening is desired by the simultaneous combination of a high strength and a great aptitude for the subsequent deformation operations and for energy absorption.

In the case of hot-rolled sheet, that is to say a sheet with a thickness ranging from about 1 to 10 mm, such properties are profitably used for lightening floor connection parts, wheels, reinforcing parts, such as door anti-intrusion bars, or parts intended for heavy vehicles (trucks, buses, etc.). In the case of cold-rolled sheet (ranging from about 0.2 mm to 6 mm in thickness), the applications are for the manufacture of parts used for safety and durability of motor vehicles, or else external parts.

To meet these simultaneous strength/ductility requirements, steels with an austenitic structure are known, such as Fe—C—Mn steels comprising up to 1.5% C and 15 to 35% Mn (contents expressed by weight) and possibly containing other elements such as silicon, aluminum or chromium. At a given temperature, the mode of deformation of austenitic steels depends only on the stacking fault energy or SFE, which physical quantity itself depends only on the composition and the temperature. When the SFE decreases, deformation passes in succession from a dislocation glide mode, then a twinning mode and finally a martensitic transformation mode. Among these modes, mechanical twinning makes it possible to achieve a high work-hardenability: twins, by acting as an obstacle to the propagation of the dislocations, help to increase the yield strength. The SFE increases in particular with the carbon and manganese contents.

Thus, Fe-0.6% C-22% Mn austenitic steels capable of deforming by twinning are known. Depending on the grain size, these steel compositions result in tensile strength values ranging from about 900 to 1150 MPa in combination with an elongation at break ranging from 50 to 80%.

However, there is an unresolved need for hot-rolled or cold-rolled steel sheet with a strength significantly greater than 1150 MPa while also having good deformability, and to do so without the addition of expensive alloys. It is desired to have steel sheet exhibiting very homogenous behavior during subsequent mechanical stressing.

The object of the invention is therefore to provide a hot-rolled or cold-rolled steel sheet or product of inexpensive manufacture, having a strength of at least 1200 MPa, or even 1400 MPa in combination with an elongation such that the product P: strength (in MPa)×elongation at break (in %) is greater than 60 000 or 50 000 MPa %, at the abovementioned strength level respectively, very homogenous mechanical properties during subsequent deformation or mechanical stressing, and a martensite-free structure at any point during or after cold deformation from this sheet or product.

For this purpose, the subject of the invention is a hot-rolled austenitic iron/carbon/manganese steel sheet, the strength of which is greater than 1200 MPa, the product P (strength (in MPa)×elongation at break (in %)) of which is greater than 65 000 MPa % and the nominal chemical composition of which comprises, the contents being expressed by weight: 0.85%≦C≦1.05%; 16%≦Mn≦19%; Si≦2%; Al≦0.050%; S≦0.030%; P≦0.050%; N≦0.1%; and, optionally, one or more elements chosen from: Cr≦1%; Mo≦1.50%; Ni≦1%; Cu s≦5%; Ti≦0.50%; Nb≦0.50%; V≦0.50%; the rest of the composition consisting of iron and inevitable impurities resulting from the smelting, the recrystallized surface fraction of the steel being equal to 100%, the surface fraction of precipitated carbides of the steel being equal to 0% and the mean grain size of the steel being less than or equal to 10 microns.

The subject of the invention is also a cold-roiled and annealed austenitic iron/carbide/manganese steel sheet, the strength of which is greater than 1200 MPa, the product P (strength (in MPa)×elongation at break (in %)) of which is greater than 65 000 MPa % and the nominal chemical composition of which comprises, the contents being expressed by weight: 0.85%≦C≦1.05%; 16%≦Mn≦19%; Si≦2%; Al≦0.050%; S≦0.030%; P≦0.050%; N≦0.1%; and, optionally, one or more elements chosen from Cr≦1%; Mo≦1.50%; Ni≦1%; Cu c 5%; Ti≦0.50%; Nb≦0.50%; V≦0.50%; the rest of the composition consisting of iron and inevitable impurities suiting, from the smelting, the recrystallized surface fraction of the steel being equal to 100%, and the mean grain size of the steel being less than 5 microns.

The subject of the invention is also a cold-rolled and annealed austenitic steel sheet, the strength of which is greater than 1250 MPa, the product P (strength (in MPa)× elongation at break (in %)) of which is greater than 65 000 MPa %, characterized in that the mean grain size of the steel is less than 3 microns.

According to a preferred feature, at any point in the austenitic steel sheet, the local carbon content $C_L$ of the steel and the local manganese content $Mn_L$, expressed by weight, are such that: % $Mn_L$+9.7% $C_L$≧21.66.

Preferably, the nominal silicon content of the steel is less than or equal to 0.6%.

According to a preferred embodiment, the nominal nitrogen content of the steel is less than or equal to 0.050%.

Also preferably, the nominal aluminum content of the steel is less than or equal to 0.030%.

According to a preferred embodiment, the nominal phosphorus content of the steel is less than or equal to 0.040%.

The subject of the invention is also a process for manufacturing a hot-rolled austenitic iron/carbide/manganese steel sheet, the strength of which is greater than 1200 MPa, the product P (strength (in MPa)×elongation at break (in %)) of which is greater than 65 000 MPa % in which process a steel is smelted, the nominal composition of which comprises, the contents being expressed by weight: 0.85%≦C≦1.05%; 16%≦Mn≦19%; Si≦2%, Al≦0.050%; S≦0.030%; P≦0.050%; N≦0.1%; and, optionally, one or more elements chosen from: Cr≦1%; Mo≦1.50%; Ni≦1%; Cu≦5%, Ti≦0.50%; Nb≦0.50%; V≦0.50%; the rest of the composition consisting of iron and inevitable impurities resulting from the smelting, a semifinished product is cast from this steel;

the semifinished product of the steel composition is heated to a temperature between 1100 and 1300° C.;

the semifinished product is rolled until an end-of-rolling temperature of 900° C. or higher;

if necessary, a hold time is observed in such a way that the recrystallized surface fraction of the steel is equal to 100%;

the sheet is cooled at a rate of 20° C./s or higher; and the sheet is coiled at a temperature of 400° C. or lower.

The subject of the invention is also a process for manufacturing a hot-rolled austenitic steel sheet, the strength of which is greater than 1400 MPa, the product P (strength (in MPa)× elongation at break (in %)) of which is greater than 50 000 MPa %, characterized in that the sheet, hot-rolled, cooled after coiling and uncoiled, undergoes cold deformation with an equivalent deformation ratio of at least 13% but at most 17%.

The subject of the invention is also a process for manufacturing a cold-rolled and annealed austenitic iron/carbon/manganese steel sheet, the strength of which is greater than 1250 MPa, the product P (strength (in MPa)×elongation at break (in %)) of which is greater than 60 000 MPa %, characterized in that a hot-rolled sheet obtained by the above process is provided; at least one cycle, each cycle consisting in cold-rolling the sheet in one or more successive passes and performing a recrystallization annealing treatment, is carried out and the mean austenitic grain size before the last cold-rolling cycle followed by a recrystallization annealing treatment is less than 15 microns.

The subject of the invention is also a process for manufacturing a cold-rolled austenitic iron/carbon/manganese steel sheet, the strength of which is greater than 1400 MPa and the product P (strength (in MPa)×elongation at break (in %)) of which is greater than 50 000 MPa %, characterized in that the sheet undergoes, after the final recrystallization annealing treatment, a cold deformation with an equivalent deformation ratio of at least 6% but at most 17%.

The subject of the invention is also a process for manufacturing a cold-rolled austenitic iron/carbon/manganese steel sheet, the strength of which is greater than 1400 MPa and the product P (strength (in MPa)×elongation at break (in %)) of which is greater than 50 000 MPa %, characterized in that a cold-rolled and annealed sheet according to the invention is provided and this sheet undergoes a cold deformation with an equivalent deformation ratio of at least 6% but at most 17%.

The subject of the invention is also a process for manufacturing an austenitic steel sheet, characterized in that the conditions under which said semifinished product is cast or reheated, such as the casting temperature of said semifinished product, the stirring of the liquid metal by electromagnetic forces and the reheating conditions leading to homogenization of the carbon and manganese contents by diffusion, are chosen so that, at any point in the sheet, the local carbon content $C_L$ and the local manganese content $Mn_L$, expressed by weight, are such that: % $Mn_L$+9.7% $C_L$≧21.66.

According to a preferred embodiment, the semifinished product is cast in slab form or cast as thin strip between counter-rotating steel rolls.

The subject of the invention is also the use of an austenitic steel sheet for the manufacture of structural or reinforcing elements or external parts in the automotive field.

The subject of the invention is also the use of an austenitic steel sheet manufactured by means of a process described above, for the manufacture of structural or reinforcing elements or external parts in the automotive field.

Other features and advantages of the invention will become apparent over the course of the description below, given by way of example and with reference to appended FIG. 1, which shows the theoretical variation of the stacking fault energy at ambient temperature (300 K) as a function of the carbon and manganese contents.

After many trials, the inventors have shown that the various requirements reported above were satisfied by observing the following conditions:

as regards the chemical composition of the steel, carbon plays a very important role in the formation of the microstructure and the mechanical properties obtained. In combination with a manganese content ranging from 16 to 19% by weight, a nominal carbon content of greater than 0.85% makes it possible to obtain a stable austenitic structure. However, for a nominal carbon content above 1.05%, it becomes difficult to prevent precipitation of carbides that occurs during certain thermal cycles in industrial manufacture, in particular when the steel is being cooled at coiling and which precipitation degrades the ductility and the toughness. In additional, increasing the carbon content reduces weldability.

Manganese is also an essential element for increasing the strength, increasing the stacking fault energy and stabilizing the austenitic phase. If its nominal content is less than 16%, there is a risk, as will be seen later, of forming a martensitic phase, which very appreciably reduces the deformability. Moreover, when the nominal manganese content is greater than 19%, the twinning deformation mode is less favored than the perfect dislocation glide mode. In addition, for cost reasons, it is undesirable for the manganese content to be high.

Aluminum is a particularly effective element for deoxidizing the steel. Like carbon, it increases the stacking fault energy. However, aluminum is a drawback if it is present in excess in steels having a high manganese content. This is because manganese increases the solubility of nitrogen in liquid iron and, if an excessively large amount of aluminum is present in the steel, nitrogen, which combines with aluminum, precipitates in the form of aluminum nitrides that impede the migration of grain boundaries during hot transformation and very appreciably increases the risk of cracks appearing. A nominal Al content of 0.050% or less prevents a precipitation of AlN. Correspondingly, the nominal nitrogen content must be 0.1% or less so as to prevent this precipitation and the formation of volume defects during solidification. This risk is particularly reduced when the nominal aluminum content is less than 0.030% and when the nominal nitrogen content is less than 0.050%.

Silicon is also an effective element for deoxidizing the steel and also for solid-phase hardening. However, above a nominal content of 2%, it reduces the elongation and tends to form undesirable oxides during certain assembling processes and must therefore be kept below this limit. This phenomenon is greatly reduced when the nominal silicon content is less than 0.6%.

Sulfur and phosphorus are impurities that embrittle the grain boundaries. Their nominal respective contents must not exceed 0.030% and 0.050% respectively so as to maintain sufficient hot ductility. When the nominal phosphorus content is less than 0.040%, the risk of embrittlement is particularly reduced.

Chromium may be optionally used to increase the strength of the steel by solid-solution hardening. However, since chromium reduces the stacking fault energy, its nominal content must not exceed 1%. Nickel increases the stacking fault energy and contributes to achieving a high elongation at break. However, it is also desirable, for cost reasons, to limit the nominal nickel content to a maximum of 1% or less. Molybdenum may also be used for similar reasons, this element furthermore retarding the precipitation of carbides. For effectiveness and cost reasons, it is desirable to limit its nominal content to 1.5% and preferably to 0.4%.

Likewise, optionally, an addition of copper up to a nominal content not exceeding 5% is one means of hardening the steel by precipitation of copper metal. However, above this content, copper is responsible for the appearance of surface defects in hot-rolled sheet.

Titanium, niobium and vanadium are also elements that may optionally be used to achieve hardening by precipitation of carbonitrides. However, when the nominal Nb or V or Ti content is greater than 0.50%, excessive carbonitride precipitation may cause a reduction in ductility and in drawability, which must be avoided.

The method of implementing the manufacturing process according to the invention is as follows. A steel having the composition mentioned above is smelted. After this smelting, the steel may be cast in ingot form or cast continuously in slab form with a thickness of around 200 mm. The steel may also be cast in thin slab form, with a thickness of a few tens of millimeters, or in thin strip form between counter-rotating steel rolls. Of course, although the present description illustrates the application of the invention to flat products, it may be applied in the same way to the manufacture of long products made of Fe—C—Mn steel.

These cast semifinished products are firstly heated to a temperature between 1100 and 1300° C. This has the purpose of making every point reach the temperature ranges favorable for the large deformations that the steel will undergo during rolling. However, the temperature must not be above 1300° C. for fear of being too close to the solidus temperature, which could be reached in any manganese- and/or carbon-segregated zones, and of causing a local onset of a liquid state that would be deleterious to hot-forming. In the case of direct casting of thin strip between counter-rotating rolls, the step of hot-rolling these semifinished products starting between 1300 and 1100° C. may take place directly after casting, so that an intermediate reheat step is unnecessary in this case.

The semifinished product production conditions (casting, reheat) have a direct influence on possible carbon and manganese segregation—this point will be discussed in detail later.

The semifinished product is hot-rolled, for example down to a hot-rolled strip thickness of a few millimeters. The low aluminum content of the steel according to the invention prevents excessive precipitation of AlN, which would impair hot deformability during rolling. To avoid any cracking problem through lack of ductility, the end-of-rolling temperature must be 900° C. or higher.

The inventors have demonstrated that the ductility properties of the sheet obtained were reduced when the recrystallized surface fraction of the steel was less than 100%. Consequently, if the hot-rolling conditions have not resulted in complete recrystallization of the austenite, the inventors have demonstrated that, after the hot-rolling phase, a hold time should be observed in such a way that the recrystallized surface fraction is equal to 100%. This high-temperature isothermal soak phase after rolling thus causes complete recrystallization.

For hot-rolled sheet, it has also been demonstrated that it is necessary to prevent carbide (essentially cementite $(Fe,Mn)_3C$ and pearlite) from precipitating, which would result in deterioration of the mechanical properties, in particular a reduction in ductility and an increase in yield strength. For this purpose, the inventors have discovered that a cooling rate after the rolling phase (or after the optional hold time needed for recrystallization) of 20° C./s or higher completely prevents this precipitation. This cooling phase is followed by a coiling operation. It has also been demonstrated that the coiling temperature should be below 400° C., again to avoid precipitation.

For steel compositions according to the invention, the inventors have demonstrated that particularly high strength and elongation at break properties are obtained when the mean austenitic grain size was equal to 10 microns or less. Under these conditions, the tensile strength of the hot-rolled sheet thus obtained is greater than 1200 MPa and the product P (strength×elongation at break) is greater than 65 000 MPa %.

There are applications in which it is desirable to obtain even higher strength characteristics on hot-rolled sheet, with a level of 1400 MPa or higher. The inventors have demonstrated that such characteristics were obtained by subjecting the hot-rolled steel sheet described above to a cold deformation with an equivalent deformation ratio of at least 13% but at most 17%. This cold deformation is therefore conferred on a sheet that has been cooled after coiling, uncoiled and usually pickled. This deformation with a relatively low ratio results in the manufacture of a product of reduced anisotropy without affecting the subsequent processing. Thus, although the process includes a cold-deformation step, the manufactured sheet may be termed "hot-rolled sheet" insofar as the cold deformation ratio is extremely small in comparison with the usual ratios produced during cold-rolling before annealing, for the purpose of manufacturing thin sheet, and insofar as the thickness of the sheet thus manufactured lies in the usual thickness range of hot-rolled sheet. However, when the equivalent cold deformation ratio is greater than 17%, the reduction in elongation becomes such that the parameter P (strength $R_m$×elongation at break A) cannot reach 50 000 MPa %. Under the conditions of the invention, despite its very high strength, the sheet retains good elongatability since the product P of the sheet thus obtained is greater than or equal to 50 000 MPa %.

In the case of cold-rolled and annealed sheet, the inventors have also demonstrated that the structure should be completely recrystallized after annealing for the purpose of achieving the desired properties. Simultaneously, when the mean grain size is less than 5 microns, the strength exceeds 1200 MPa and the product P is greater than 65 000 MPa %. When the mean grain size obtained after annealing is less than 3 microns, the strength exceeds 1250 MPa, the product P still being greater than 65 000 MPa %.

The inventors have also discovered a process for manufacturing cold-rolled and annealed steel sheet with a strength of greater than 1250 MPa and a product P greater than 60 000 MPa %, by supplying hot-rolled sheet according to the process described above and then carrying out at least one cycle, in which each cycle consists of the following steps:

cold-rolling in one or more successive passes; and recrystallization annealing, the mean austenitic grain size before the last cold-rolling cycle, subjected to recrystallization annealing, being less than 15 microns.

It may be desirable to obtain a cold-rolled sheet with an even higher strength, greater than 1400 MPa. The inventors have demonstrated that such properties could be achieved by providing a cold-rolled sheet possessing the characteristics according to the invention described above or by providing a cold-rolled sheet obtained using the process according to the invention described above. The inventors have discovered that applying a cold deformation to such a sheet with an equivalent deformation ratio of at least 6% but at most 17% makes it possible to achieve a strength of greater than 1400 MPa and a product P greater than 50 000 MPa %. When the equivalent cold deformation ratio is greater than 17%, the reduction in elongation becomes such that the parameter P cannot reach 50 000 MPa %.

The particularly important role played by carbon and manganese within the context of the present invention will now be explained in detail. To do this, reference will be made to FIG. 1, which shows, in a carbon-manganese plot (the balance being iron), the calculated stacking fault isoenergy curves, the values of which range from 5 to 30 mJ/m$^2$. At a given deformation temperature and for a given grain size, the mode of deformation is theoretically identical for any Fe—C—Mn alloy having the same SFE. Also depicted in this plot is the martensite onset region.

The inventors have demonstrated that it is necessary, in order to appreciate the mechanical behavior, to consider not only the nominal chemical composition of the alloy, for example its nominal or mean content of carbon and manganese, but also its local content.

This is because it is known that, during production of the steel, solidification causes certain elements to be segregated to a greater or lesser amount. This arises from the fact that the solubility of an element within the solid phase is different from that in the liquid phase. Thus, solid nuclei, the solute content of which is below the nominal composition, will frequently occur, the final phase of the solidification involving a solute-enriched residual liquid phase. This primary solidification structure may adopt various morphologies (for example a dendritic or equiaxed morphology) and be pronounced to a greater or lesser extent. Even if these characteristics are modified by the rolling and subsequent heat treatments, analysis of the local elemental content indicates a fluctuation around a value corresponding to the mean or nominal content of this element.

The term "local content" is understood here to mean the content measured by means of a device such as an electron probe. A linear or surface scan by means of such a device allows the variation in local content to be determined.

Thus, the variation in local content of an Fe—C—Mn alloy, the nominal composition of which is C=0.23%, Mn=24%, Si=0.203%, N=0.001%, was measured. The inventors have demonstrated cosegregation of carbon and manganese—locally carbon-enriched (or carbon-depleted) zones also correspond to manganese-enriched (or manganese-depleted) zones. Each measured point having a local carbon concentration ($C_L$) and local manganese concentration ($Mn_L$) has been plotted in FIG. 1, the combination forming a segment representing the local carbon and manganese variation in the steel sheet, centered on the nominal content (C=0.23%/Mn=24%). In this case, it may be seen that the variation in local carbon and manganese content is manifested by a variation in the stacking fault energy, since this value ranges from 7 mJ/m$^2$ for the zones less rich in C and in Mn up to about 20 mJ/m$^2$ for the richest zones. Moreover, it is known that twinning occurs as preferential deformation mode at room temperature when the SFE is about 15-30 mJ/m$^2$. In the above case, this preferential mode of deformation may not be absolutely present throughout the steel sheet and certain particular zones may possibly exhibit a mechanical behavior different from that expected for a steel sheet of nominal composition, in particular a lower deformability by twinning within certain grains. More generally, it is considered that, under very particular conditions depending for example on the deformation or stressing temperature, on the grain size, the local carbon and manganese contents may be reduced to the point of locally causing a deformation-induced martensitic transformation.

The inventors have sought the particular conditions for obtaining very high mechanical properties simultaneously with great homogeneity of these properties within a steel sheet. As explained above, the combination of a carbon content (0.85%-1.05%) and a manganese content (16-19%) associated with other properties of the invention results in strength values greater than 1200 MPa and a product P (strength× elongation at break) greater than 60 000, or even 65 000 MPa %. It will be seen in FIG. 1 that these steel compositions lie in a region in which the SFE is around 19-24 mJ/m$^2$, that is to say favorable for deformation by twinning. However, the inventors have also demonstrated that a variation in the local carbon or manganese content has a much lower influence than that mentioned in the previous example. This is because measurements of the variations in local contents ($C_L$, $Mn_L$) carried out on various Fe—C—Mn austenitic steel compositions have shown, under identical manufacturing conditions, cosegregation of carbon and manganese very close to that illustrated in FIG. 1. Under these conditions, a variation in the local contents ($C_L$, $Mn_L$) has only a slight consequence on the mechanical behavior, since the segment representing this cosegregation lies along a direction approximately parallel to the iso-SFE curves.

In addition, the inventors have demonstrated that the formation of martensite during the deformation operations or during use of the sheet should be absolutely avoided, for fear of the mechanical properties on parts being heterogeneous. The inventors have determined that this condition is satisfied when, at any point in the sheet, the local carbon and manganese contents of the sheet are such that: $\% Mn_L + 9.7\% C_L \geqq 21.66$. Thus, thanks to the characteristics of the nominal chemical composition that are defined by the invention, and those defined by the local carbon and manganese contents, austenitic steel sheet is achieved that has not only very high mechanical properties but also very low dispersion of these properties.

A person skilled in the art, through his general knowledge, will adapt the manufacturing conditions so as to satisfy this relationship relating to the local contents, in particular by means of the casting conditions (casting temperature, electromagnetic stirring of the liquid metal) or the reheat conditions resulting in homogenization of the carbon and manganese by diffusion.

In particular, it will be advantageous to carry out processes for casting semifinished products in thin slab form (with a thickness of a few centimeters) or thin strip form, since these processes are generally associated with reduction in local compositional heterogeneities.

By way of nonlimiting example, the following results will show the advantageous features conferred by the invention.

EXAMPLE

Steels with the following nominal composition (contents expressed in percentages by weight) were smelted:

TABLE 1

| Nominal compositions of the steels | | | | | | | | | | | | |
|---|---|---|---|---|---|---|---|---|---|---|---|---|
| Steel | | C | Mn | Si | S | P | Al | Cu | Cr | Ni | Mo | N |
| I | According to the invention | 0.97 | 17.6 | 0.51 | 0.001 | 0.005 | 0.030 | | 0.005 | | | 0.025 |
| R1 | Ref. | 0.61 | 21.5 | 0.49 | 0.001 | 0.016 | 0.003 | 0.02 | 0.053 | 0.044 | 0.009 | 0.01 |
| R2 | Ref. | 0.45 | 17.5 | 0.3 | 0.001 | 0.005 | 0.030 | | | | | 0.01 |

After casting, a semifinished product of steel I according to the invention was reheated to a temperature of 1180° C. and hot-rolled until a temperature above 900° C. in order to achieve a thickness of 3 mm. A hold time of 2 s after rolling was observed, for the purpose of complete recrystallization, and then the product was cooled at a rate of greater than 20° C./s followed by coiling at ambient temperature.

The reference steels were reheated to a temperature above 1150° C., rolled until an end-of-rolling temperature of greater than 940° C., and then coiled at a temperature below 450° C.

The recrystallized surface fraction was 100% for all the steels, the fraction of precipitated carbides was 0% and the mean grain size was between 9 and 10 microns.

The tensile properties of the hot-rolled sheets were the following:

TABLE 2

| Tensile properties of the hot-rolled sheets | | | |
|---|---|---|---|
| Steel | Strength | Elongation at break | P = strength × elongation at break |
| According to the invention I | 1205 MPa | 64% | 77 000 MPa % |
| Reference Rl | 1010 MPa | 65% | 66 180 MPa % |
| Reference R2 | 1050 MPa | 45% | 47 250 MPa % |

Compared with a reference steel R1, the mechanical properties of which are already high, the steel according to the invention made it possible to obtain a strength increased by about 200 MPa, with a very comparable elongation.

To evaluate the structural and mechanical homogeneity during a deformation, drawn cups were produced, on which the microstructure was examined by X-ray diffraction. In the case of reference steel R2, the appearance of martensite was observed whenever the deformation ratio exceeded 17%, the total drawing operation resulting in fracture. An analysis indicated that the characteristic: $\% Mn_L + 9.7\% C_L \geqq 21.66$ was not fulfilled at any point (FIG. 1).

In the case of the steel according to the invention, no trace of martensite could be found, and a similar analysis indicated that the characteristic $\% Mn_L + 9.7\% C_L \geqq 21.66$ was satisfied at every point, thereby preventing any appearance of martensite.

The steel sheet according to the invention then underwent slight cold deformation by rolling with an equivalent deformation of 14%. The strength of the product was then 1420 MPa and its elongation at break was 42%, i.e. a product P=59 640 MPa %. This product having exceptionally high mechanical properties offers great potential for subsequent deformation owing to its reserve of plasticity and its low anisotropy.

Moreover, after the coiling, uncoiling and pickling steps, hot-rolled sheet of steel according to the invention and that of the steel R1 were then cold-rolled, before being annealed so as to obtain a completely recrystallized structure. The mean austenitic grain size, the strength and the elongation at break are indicated in the table below.

TABLE 3

| Mechanical properties of the cold-rolled and annealed sheet products | | | | |
|---|---|---|---|---|
| Steel | Mean grain size | Strength | Elongation at break | Product P (strength × elongation at break) |
| According to the invention I | 4 microns | 1289 MPa | 58% | 74 760 MPa % |
| Reference R1 | 3 microns | 1130 MPa | 55% | 62 150 MPa % |

The steel sheet produced according to the invention, the mean grain size of which is 4 microns, therefore gives a particularly advantageous strength/elongation combination and a significant increase in strength compared with the reference steel. As in the case of the hot-rolled sheet products, these properties are obtained with very great homogeneity in the product, no trace of martensite being present after deformation.

Equi-biaxial expansion trials using a 75 mm-diameter hemispherical punch, carried out on a cold-rolled and annealed sheet 1.6 mm in thickness, according to the invention, gave a drawing limit depth of 33 mm, demonstrating excellent deformability. Bending tests carried out on this same sheet also showed that the critical deformation before cracks appeared was greater than 50%.

The steel sheet produced according to the invention was subjected to cold deformation by rolling with an equivalent deformation ratio of 8%. The strength of the product was then 1420 MPa and its elongation at break was 48%, i.e. a product P=68 160 MPa %.

Thus, owing to their particularly high mechanical properties, their very homogenous mechanical behavior and their microstructural stability, the hot-rolled or cold-rolled steels according to the invention will be advantageously used for applications in which it is desired to achieve a high deformability and a very high strength. When they are used in the automotive industry, their advantages will be profitably used for the manufacture of structural parts, reinforcing elements or even external parts.

The invention claimed is:

1. A hot-rolled austenitic iron/carbon/manganese steel sheet, wherein a strength of the steel sheet is greater than 1200 MPa; a product P of a strength in MPa×an elongation at break in % of the steel sheet is greater than 65000 MPa %; a nominal chemical composition of the steel sheet comprises iron and inevitable impurities and, by weight:

0.85% ≦ C ≦ 1.05%
16% ≦ Mn ≦ 19%
Si ≦ 2%
Al ≦ 0.050%
S ≦ 0.030%
P ≦ 0.050%
N ≦ 0.1%, and, optionally, one or more elements selected from the group consisting of:

Cr ≦ 1%
Mo ≦ 1.50%
Ni ≦ 1%
Cu ≦ 5%
Ti ≦ 0.50%
Nb ≦ 0.50%
V ≦ 0.50%;

a recrystallized surface fraction of said steel is equal to 100%; a surface fraction of precipitated carbides of said steel sheet is equal to 0%; a mean grain size of the steel sheet is less than or equal to 10 microns; and, at any point in said steel sheet, a local carbon content $C_L$ and a local manganese content $Mn_L$, expressed by weight, satisfy % $Mn_L$+9.7% $C_L$≧21.66.

2. A cold-rolled and annealed austenitic iron/carbon/manganese steel sheet, wherein a strength of the steel sheet is greater than 1200 MPa; a product P of a strength in MPa×an elongation at break in % of the steel is greater than 65000 MPa %; a nominal chemical composition of the steel sheet comprises iron and inevitable impurities and, by weight:

0.85% ≦ C ≦ 1.05%
16% ≦ Mn ≦ 19%
Si ≦ 2%
Al ≦ 0.050%
S ≦ 0.030%
P ≦ 0.050%
N ≦ 0.1%, and, optionally, one or more elements selected from the group consisting of:

Cr ≦ 1%
Mo ≦ 1.50%
Ni ≦ 1%
Cu ≦ 5%
Ti ≦ 0.50%
Nb ≦ 0.50%
V ≦ 0.50%;

a recrystallized surface fraction of the steel sheet is equal to 100%; a mean grain size of said steel sheet is less than 5 microns; and, at any point in said steel sheet, a local carbon content $C_L$ and a local manganese content $Mn_L$, expressed by weight, satisfy % $Mn_L$+9.7% $C_L$≧21.66.

3. The cold-rolled and annealed austenitic steel sheet according to claim 2, wherein the strength of the steel sheet is greater than 1250 MPa; the product P of a strength in MPa×an elongation at break in % of the steel sheet is greater than 65000 MPa %; and the mean grain size of said steel sheet is less than 3 microns.

4. The steel sheet according to claim 1, wherein the nominal silicon content of said steel sheet is less than or equal to 0.6%.

5. The steel sheet according to claim 1, wherein the nominal nitrogen content of said steel sheet is less than or equal to 0.050%.

6. The steel sheet according to claim 1, wherein the nominal aluminum content of said steel sheet is less than or equal to 0.030%.

7. The steel sheet according to claim 1, wherein the nominal phosphorus content of said steel sheet is less than or equal to 0.040%.

8. A process for manufacturing a hot-rolled austenitic iron/carbon/manganese steel sheet, wherein a strength of the steel sheet is greater than 1200 MPa; a product P of a strength in MPa×an elongation at break in % of the steel sheet is greater than 65000 MPa %; a nominal composition of the steel sheet comprises iron and inevitable impurities and, by weight:

0.85% ≦ C ≦ 1.05%
16% ≦ Mn ≦ 19%
Si ≦ 2%
Al ≦ 0.050%
S ≦ 0.030%
P ≦ 0.050%
N ≦ 0.1%, and, optionally, one or more elements selected from the group consisting of:

Cr ≦ 1%
Mo ≦ 1.50%
Ni ≦ 1%
Cu ≦ 5%
Ti ≦ 0.50%
Nb ≦ 0.50%
V ≦ 0.50%; and said process comprises: smelting steel;

casting a semi-finished product from said steel smelt;

heating said semi-finished product to a temperature between 1100 and 1300° C.;

rolling said semi-finished product to an end-of rolling temperature of 900° C. or higher to form steel sheet;

observing, optionally, a hold time at a temperature of 900° C. or higher so that a recrystallized surface fraction of the steel sheet is equal to 100%;

cooling said sheet at a rate of 20° C./s or higher; and coiling said sheet at a temperature of 400° C. or lower, wherein, at any point in said steel sheet, a local carbon content $C_L$ and a local manganese content $Mn_L$, expressed by weight, satisfy % $Mn_L$+9.7% $C_L$≧21.66.

9. A process for manufacturing a cold-rolled austenitic steel sheet, wherein a strength of the steel sheet is greater than 1400 MPa; a product P of a strength in MPa×an elongation at break in % of the steel sheet is greater than 50000 MPa %, wherein a nominal composition of the steel sheet comprises iron and inevitable impurities and, by weight:

| |
|---|
| 0.85% ≦ C ≦ 1.05% |
| 16% ≦ Mn ≦ 19% |
| Si ≦ 2% |
| Al ≦ 0.050% |
| S ≦ 0.030% |
| P ≦ 0.050% |
| N ≦ 0.1%, |

and, optionally, one or more elements selected from the group consisting of:

| |
|---|
| Cr ≦ 1% |
| Mo ≦ 1.50% |
| Ni ≦ 1% |
| Cu ≦ 5% |
| Ti ≦ 0.50% |
| Nb ≦ 0.50% |
| V ≦ 0.50%; and, |

said process comprises: smelting steel;

casting a semi-finished product from said steel smelt;

heating said semi-finished product to a temperature between 1100 and 1300° C.;

rolling said semi-finished product to an end-of rolling temperature of 900° C. or higher to form steel sheet;

observing, optionally, a hold time at a temperature of 900° C. or higher so that a recrystallized surface fraction of the steel sheet is equal to 100%;

cooling said sheet at a rate of 20° C./s or higher; and coiling said sheet at a temperature of 400° C. or lower; cooling after coiling and uncoiling; and cold deforming with an equivalent deformation ratio of at least 13 but at most 17%.

10. A process for manufacturing a cold-rolled and annealed austenitic iron/carbon/manganese steel sheet, wherein the strength of the steel sheet is greater than 1250 MPa; and a product P of a strength in MPa×an elongation at break in % of the steel sheet is greater than 60000 MPa %; and said process comprises:

providing a hot-rolled sheet obtained by the process according to claim 8;

carrying out at least one cycle, each cycle consisting of: cold-rolling said sheet in one or more successive passes and performing a recystallization annealing treatment;

wherein a mean austenitic grain size before the last cold-rolling cycle followed by a recrystallization annealing treatment is less than 15 microns, wherein, at any point in said steel sheet, a local carbon content $C_L$ and a local manganese content $Mn_L$, expressed by weight, satisfy % $Mn_L$+9.7% $C_L$≧21.66.

11. A process for manufacturing a cold-rolled austenitic iron/carbon/manganese steel sheet, wherein a strength of the steel is greater than 1400 MPa and a product P of a strength in MPa×an elongation at break in % of the steel sheet is greater than 50000 MPa % of at least 6% but at most 17%, and said process comprises:

providing a hot-rolled sheet obtained by the process according to claim 8;

carrying out at least one cycle, each cycle consisting of: cold-rolling said sheet in one or more successive passes and performing a recystallization annealing treatment;

wherein a mean austenitic grain size before the last cold-rolling cycle followed by a recrystallization annealing treatment is less than 15 microns; and after final recrystallization annealing treatment, cold deforming with an equivalent deformation ratio of at least 6% but at most 17%.

12. A process for manufacturing a cold-rolled austenitic iron/carbon/manganese steel sheet, wherein a strength of the steel sheet is greater than 1400 MPa and a product P of a strength in MPa×an elongation at break in % of the steel sheet is greater than 50000 MPa %, wherein a cold-rolled and annealed sheet is provided and said sheet undergoes cold deforming with an equivalent deformation ratio of at least 6% but at most 17%, wherein a nominal chemical composition of the cold-rolled and annealed steel sheet comprises iron and inevitable impurities and, by weight:

| |
|---|
| 0.85% ≦ C ≦ 1.05% |
| 16% ≦ Mn ≦ 19% |
| Si ≦ 2% |
| Al ≦ 0.050% |
| S ≦ 0.030% |
| P ≦ 0.050% |
| N ≦ 0.1%, |

and, optionally, one or more elements selected from the group consisting of:

| |
|---|
| Cr ≦ 1% |
| Mo ≦ 1.50% |
| Ni ≦ 1% |
| Cu ≦ 5% |
| Ti ≦ 0.50% |
| Nb ≦ 0.50% |
| V ≦ 0.50%; and |

a recrystallized surface fraction of the cold-rolled and annealed steel sheet is equal to 100%; a mean grain size of said steel sheet is less than 5 microns.

13. The manufacturing process as claimed in claim 8, characterized in that said semifinished product is cast in slab form or as a thin strip between counter-rotating steel rolls.

14. A structural part comprising an austenitic steel sheet according to claim 1.

15. A manufacturing process as claimed in claim 8, comprising a step of forming said hot rolled austenitic steel sheet to produce a structural part, reinforcing element or external part for the automotive field.

16. The process according to claim 9, wherein the nominal silicon content of said steel sheet is less than or equal to 0.6%.

17. The process according to claim 9, wherein the nominal nitrogen content of said steel sheet is less than or equal to 0.050%.

18. The process according to claim 9, wherein the nominal phosphorus content of said steel sheet is less than or equal to 0.040%.

19. The process according to claim 12, wherein the mean grain size of said steel sheet is less than 3 microns.

* * * * *